US009918607B1

(12) United States Patent
Lewis et al.

(10) Patent No.: US 9,918,607 B1
(45) Date of Patent: Mar. 20, 2018

(54) CONTINUOUSLY ADJUSTABLE MOP FRAME

(71) Applicant: GOLDEN STAR, INC., Overland Park, KS (US)

(72) Inventors: Steven M. Lewis, Platte City, MO (US); Earl D. Julo, Overland Park, KS (US)

(73) Assignee: GOLDEN STAR, INC., Overland Park, KS (US)

( * ) Notice: Subject to any disclaimer, the term of this patent is extended or adjusted under 35 U.S.C. 154(b) by 0 days.

(21) Appl. No.: 15/612,287

(22) Filed: Jun. 2, 2017

(51) Int. Cl.
*A47L 13/254* (2006.01)
*A47L 13/258* (2006.01)
*A47L 13/255* (2006.01)

(52) U.S. Cl.
CPC ..... *A47L 13/258* (2013.01); *A47L 13/254* (2013.01); *A47L 13/255* (2013.01)

(58) Field of Classification Search
CPC ..... A47L 13/254; A47L 13/255; A47L 13/258
USPC ..... 15/147.1, 228, 229.6
See application file for complete search history.

(56) References Cited

U.S. PATENT DOCUMENTS 2,903,730 A * 9/1959 Murphy ..... A47L 13/258 15/144.1
4,070,726 A * 1/1978 Joffre ..... A47L 13/256 15/144.2
4,766,632 A * 8/1988 Murray ..... A47L 13/258 15/144.1
4,845,800 A 7/1989 Pederson et al.
4,881,290 A 11/1989 Bohacek
5,218,734 A 6/1993 Sacks
7,607,191 B2 * 10/2009 Morris ..... A47L 13/258 15/147.1
8,640,296 B2 2/2014 Weaver et al.
9,282,868 B2 * 3/2016 Ehrenberger ..... A47L 11/4061
9,750,386 B2 * 9/2017 Zeng ..... A47L 13/258
9,826,879 B2 * 11/2017 Rueckheim ..... A47L 13/256

FOREIGN PATENT DOCUMENTS

CN 203898228 10/2014
CN 204708786 10/2015
DE 3808310 9/1989

* cited by examiner

*Primary Examiner* — Michael Jennings
(74) *Attorney, Agent, or Firm* — Stinson Leonard Street LLP

(57) ABSTRACT

A mop frame with a base, a first extension that is slidably coupled to the base, a second extension that is slidably coupled to the base, a first lock that is mounted to the base, and a second lock that is mounted to the base. The first extension and second extension are each operable to slide with respect to the base between a retracted position and an extended position. The first lock and second lock are operable to releasably lock the first extension and second extension, respectively, to the base in any position between the retracted position and the extended position.

22 Claims, 11 Drawing Sheets

CONTINUOUSLY ADJUSTABLE MOP FRAME

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates to a mop, and in particular, to a continuously adjustable mop frame.

2. Description of Related Art

There are many types of floor mops designed for a variety of cleaning needs. Dust mops, for example, are commonly used for the routine cleaning of dust, dirt, and debris from floor surfaces such as school and public building hallways, gymnasium floors, and warehouse floors. Dust mops typically include a mop frame that receives a dust mop head. Dust mop heads are available in different lengths designed for different applications. For example, a relatively short dust mop head of 24" may be used for the cleaning of smaller spaces and around obstacles, while a relatively long dust mop head of 60" may be used for the efficient cleaning of larger spaces. In order to allow one mop frame to be used with different lengths of mop heads, it is known to provide a mop frame that is discretely adjustable from at least one length to a second length.

A dust mop head may be removed from a mop frame for replacement and laundering. After laundering, a dust mop head may shrink making it difficult to remount the dust mop head on the mop frame. One known solution to the issue of shrinking dust mop heads is to provide a dust mop frame that has a limited range of lengthwise adjustability. Conventional mop heads, however, are not adapted for use with a wide range of mop heads having different lengths and mop heads that have shrunk from their initial size.

BRIEF SUMMARY OF THE INVENTION

A mop frame in accordance with one embodiment of the invention described herein has a base, a first extension that is slidably coupled to the base, a second extension that is slidably coupled to the base, a first lock that is mounted to the base, and a second lock that is mounted to the base. The base has a first end and a second end, with a longitudinal axis of the base extending from the first end to the second end. The first extension and second extension are each operable to slide with respect to the base in a direction aligned with the longitudinal axis between a retracted position and an extended position. The first lock and second lock are operable to releasably lock the first extension and second extension, respectively, to the base in any position between the retracted position and the extended position.

Preferably, each of the first extension and the second extension has a proximal end and a distal end. In the retracted position, the proximal end of the first extension is preferably adjacent the second end of the base, the distal end of the first extension is preferably adjacent the first end of the base, the proximal end of the second extension is preferably adjacent the first end of the base, and the distal end of the second extension is preferably adjacent the second end of the base. In the extended position, the proximal end of the first extension is preferably adjacent the first end of the base, and the proximal end of the second extension is preferably adjacent the second end of the base.

The first lock preferably includes a support surface that is mounted to the base, a tab that is coupled to the support surface, and a spring that is positioned between the tab and the support surface. The tab preferably has an opening that receives a portion of the first extension. The tab is preferably movable with respect to the support surface between an engaged position, in which a portion of the tab surrounding the opening in the tab engages the first extension to releasably lock the first extension to the base in any position between the retracted position and the extended position, and a disengaged position, in which the first extension is operable to slide relative to the tab. The spring preferably biases the tab to the engaged position. The second lock preferably has a similar configuration as the first lock with a second tab that is operable to engage the second extension and releasably lock the second extension to the base in any position between the retracted position and the extended position.

The configuration and slidable movement of the first and second extensions relative to the base preferably allows the mop frame to have a wide range of lengthwise adjustability for use with a variety of mop heads having different lengths. Further, if a particular mop head shrinks due to laundering after extended use, the first and second extensions are continuously adjustable with respect to base such that they may be retracted with respect to base to match the shortened length of the mop head. To accommodate the continuous adjustability of first and second extensions, first and second locks can releasably lock the first and second extensions, respectively, to the base in any position between the retracted and extended positions of the extensions. The mop frame is preferably used with a dust mop head for dust control.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF PREFERRED EMBODIMENT

Figure 1:
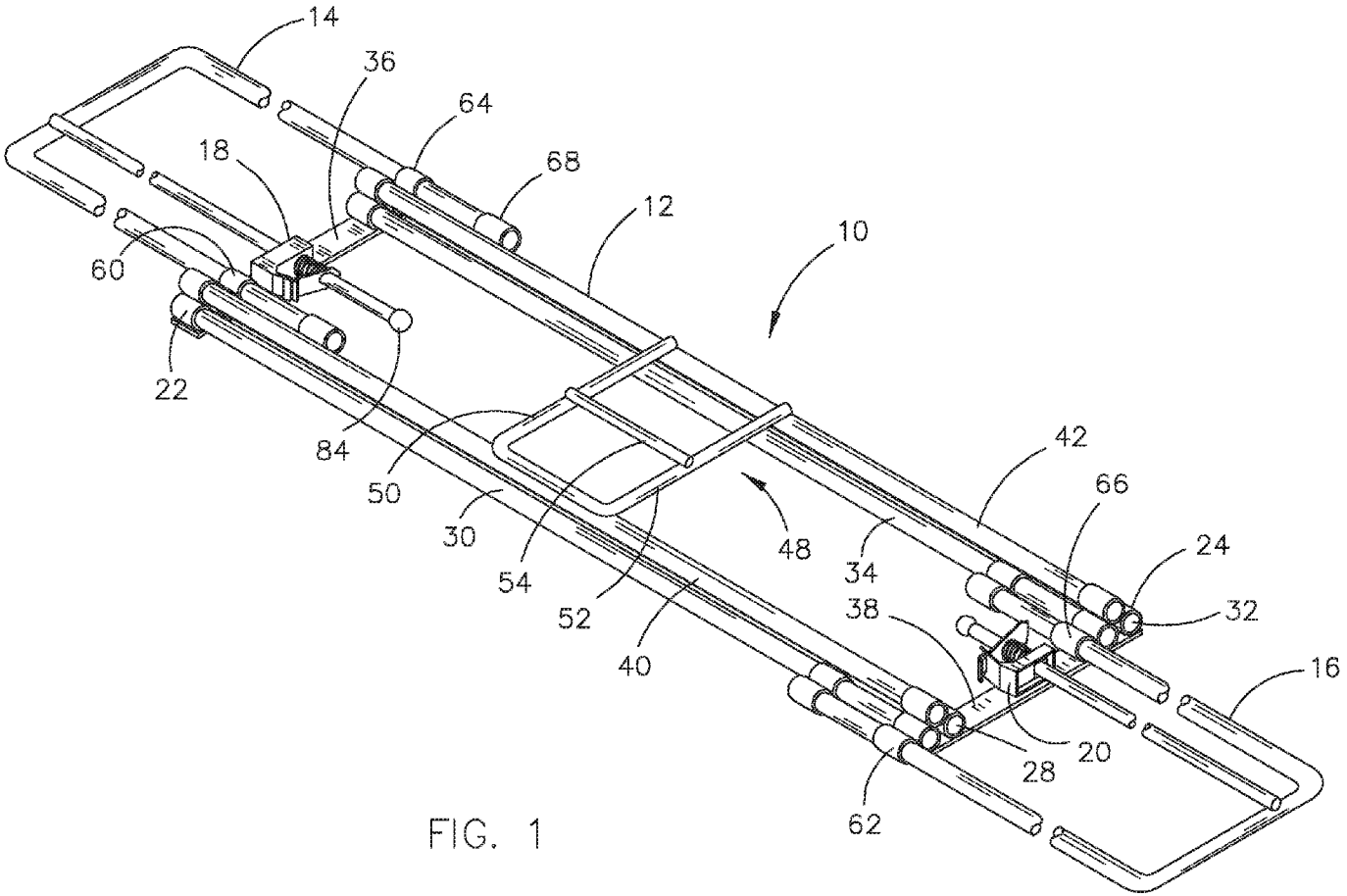
FIG. 1 is a perspective view of a mop frame in accordance with one embodiment of the invention described herein.

A mop frame in accordance with the invention described herein is generally identified with the numeral 10 in FIG. 1. Mop frame 10 has a base 12, a first extension 14, a second extension 16, a first lock 18, and a second lock 20. As described in detail below, first extension 14 and second extension 16 are each slidable with respect to base 12 between the retracted positions shown in FIG. 4 and the extended positions shown in FIG. 3. First lock 18 is operable to releasably lock first extension 14 to base 12 in the extended position, the retracted position, and any position between the extended and retracted positions. Second lock 20 is operable to releasably lock second extension 16 to base 12 in the extended position, the retracted position, and any position between the extended and retracted positions. Because first extension 14 and second extension 16 may be releasably locked into any position between their extended and retracted positions, mop frame 10 has an overall length that is continuously adjustable between the length shown in FIG. 4 with the first extension 14 and second extension 16 in their retracted positions and the length shown in FIG. 3 with the first extension 14 and second extension 16 in their extended positions. Being continuously adjustable, mop frame 10 can be used with any length of mop head that is between the retracted length of mop frame 10 shown in FIG. 4 and the extended length of mop frame 10 shown in FIG. 3. Mop frame 10 is preferably adapted for use with a dust mop head.

Figure 2:
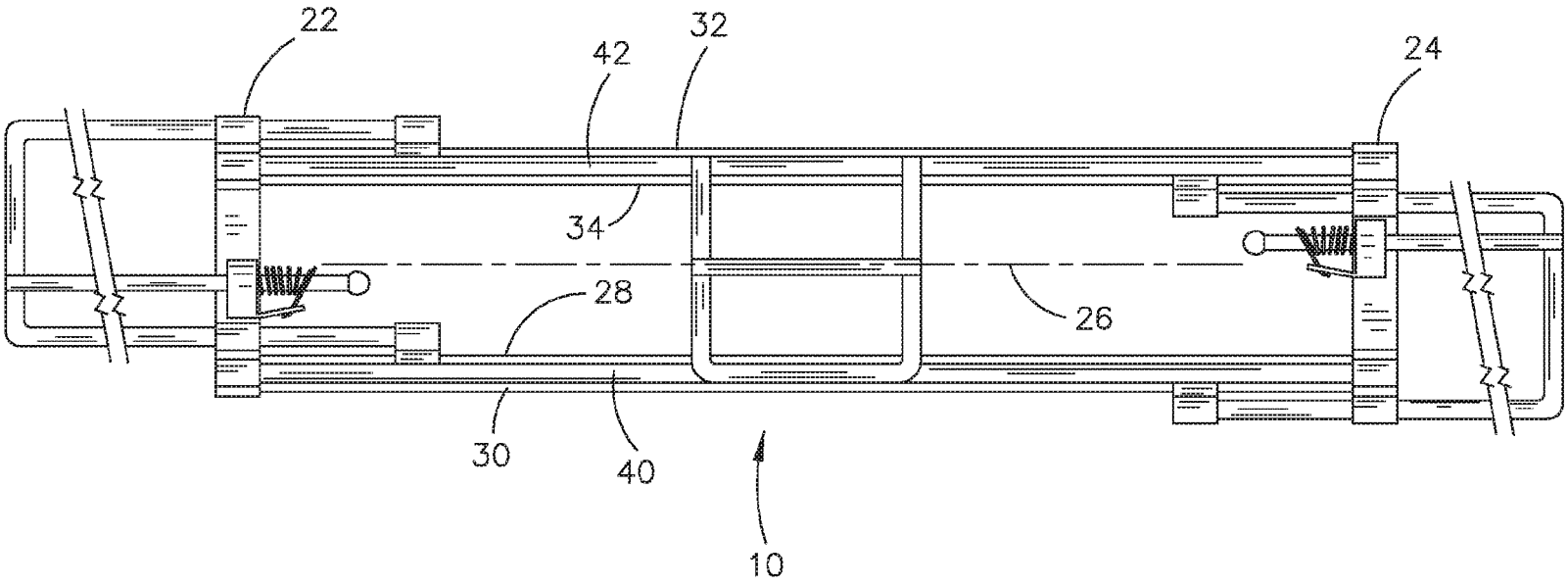
FIG. 2 is a top plan view of the mop frame of FIG. 1.

Referring to FIG. 1, base 12 has a first end 22 and a second end 24. A longitudinal axis 26 (FIG. 2) of base 12 extends from the first end 22 to the second end 24. Base 12 has a length X (FIG. 3) extending along longitudinal axis 26 from first end 22 to second end 24. Base 12 includes a first rail 28, a second rail 30, a third rail 32, and a fourth rail 34 each of which extends from first end 22 to second end 24. Each of the first rail 28, second rail 30, third rail 32, and fourth rail 34 is configured as a cylindrical rod; however, it is within the scope of the invention for these rails to have any shape, including a hollow tubular shape. Base 12 has a first end frame member 36 that is positioned at first end 22 and a second end frame member 38 that is positioned at second end 24. Each of the first end frame member 36 and the second end frame member 38 is configured as a generally planar rectangular plate; however, it is within the scope of the invention for these end frame members to have any shape. Each of the first rail 28, second rail 30, third rail 32, and fourth rail 34 is mounted at one end to a top surface of the first end frame member 36 and at an opposite end to a top surface of the second end frame member 38. Second rail 30 and third rail 32 are positioned on the outer edges of base 12 and first rail 28 and fourth rail 34 are positioned inside of second rail 30 and third rail 32. First rail 28 is positioned between second rail 30 and fourth rail 34, and fourth rail 34 is positioned between first rail 28 and third rail 32. First rail 28 and third rail 32 are preferably spaced apart across the width of base 12 (perpendicular to longitudinal axis 26) a distance that is approximately equal to the spacing between second rail 30 and fourth rail 34. First, second, third, and fourth rails 28, 30, 32, and 34 are preferably mounted to first and second end frame members 36 and 38 by welding; however, it is within the scope of the invention for the rails to be mounted to the end frame members in any suitable manner. Further, first, second, third, and fourth rails 28, 30, 32, and 34 may be made integral with first and second end frame members 36 and 38 from the same material.

Base 12 has a first side frame member 40 and a second side frame member 42 each of which extends from first end 22 to second end 24 and each of which is coupled at one end to the first end frame member 36 and at an opposite end to the second end frame member 38. Each of the first side frame member 40 and the second side frame member 42 is configured as a cylindrical rod; however, it is within the scope of the invention for these side frame members to have any shape, including a hollow tubular shape. First side frame member 40 is positioned above first rail 28 and second rail 30 and is mounted at each of its ends to both first rail 28 and second rail 30. Second side frame member 42 is positioned above third rail 32 and fourth rail 34 and is mounted at each of its ends to both third rail 32 and fourth rail 34. First side frame member 40 is preferably mounted to first rail 28 and second rail 30 by welding, and second side frame member 42 is preferably mounted to third rail 32 and fourth rail 34 by welding. However, it is within the scope of the invention for first side frame member 40 to be mounted to first rail 28 and second rail 30 in any suitable manner, and it is within the scope of the invention for second side frame member 42 to be mounted to third rail 32 and fourth rail 34 in any suitable manner. Further, first side frame member 40 may be made integral with first and second rails 28 and 30 from the same material, and second side frame member 42 may be made integral with third and fourth rails 32 and 34 from the same material.

Figure 6:
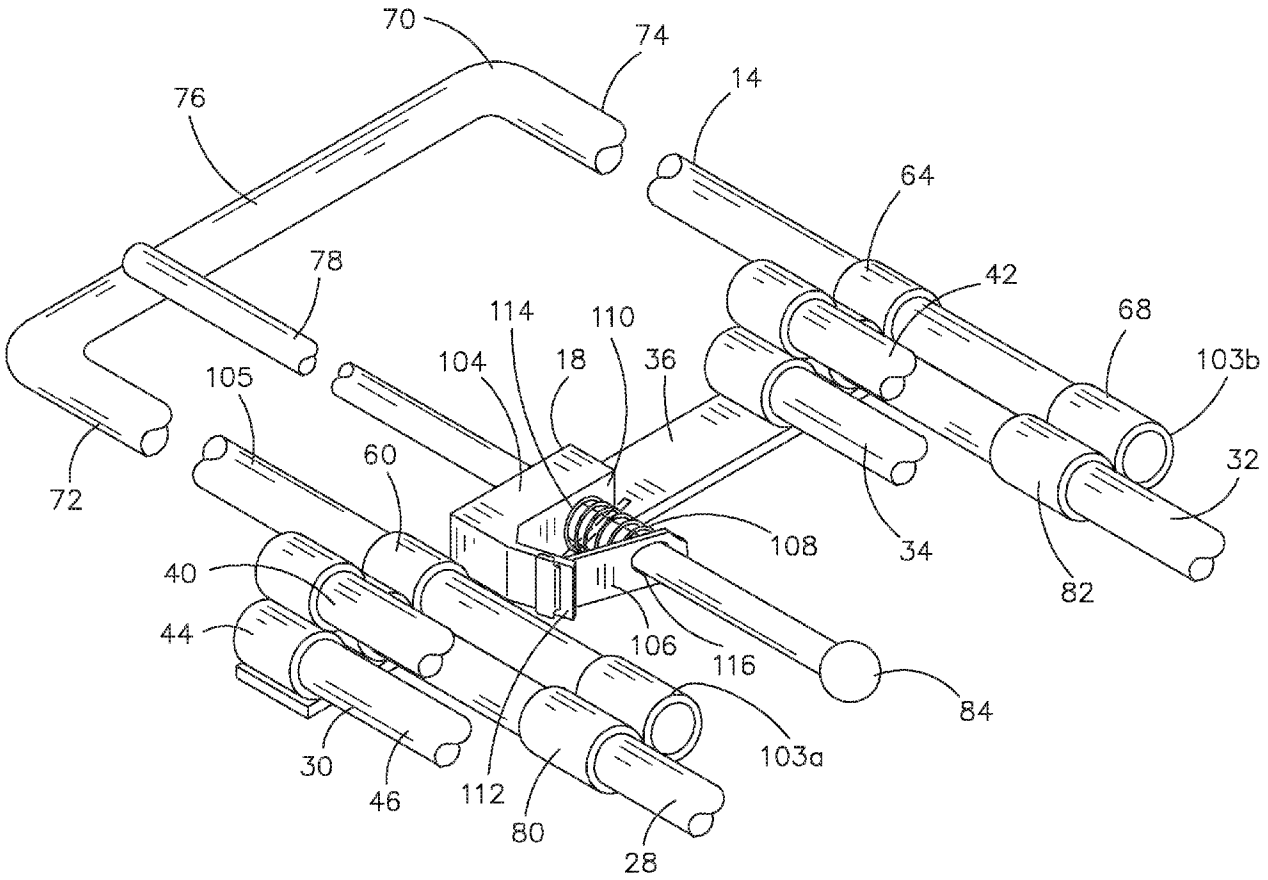
FIG. 6 is a perspective view showing a first end of a base of the mop frame of FIG. 1.

Each end of second rail 30 includes a stopper, one of which is identified in FIG. 6 as 44, that receives and is joined to, preferably by welding, a longer rod 46. The stopper 44 is mounted to first end frame member 36. Alternatively, it is within the scope of the invention for the second rail 30 to be constructed from one continuous piece, such as rod 46, that is directly mounted to first end frame member 36 and second end frame member 38 without the stopper 44. First rail 28, third rail 32, fourth rail 34, first side frame member 40, and second side frame member 42 also have a similar construction as second rail 30 with stoppers at each end that are joined to a longer rod, as shown in FIG. 1. It is also within the scope of the invention for first rail 28, third rail 32, fourth rail 34, first side frame member 40, and second side frame member 42 to be constructed from one continuous piece that is directly mounted to first end frame member 36, second end frame member 38, first rail 28, second rail 30, third rail 32, and/or fourth rail 34, without the use of stoppers. The stopper 44 of second rail 30 and the stoppers of first rail 28, third rail 32, and fourth rail 34 can engage one of the first bushing 80, second bushing 98, third bushing 82, and fourth bushing 100 described below (and shown in FIGS. 6 and 7)

to prevent first and second extensions 14 and 16 from being disconnected from base 12 when in the extended positions.

Figure 8:
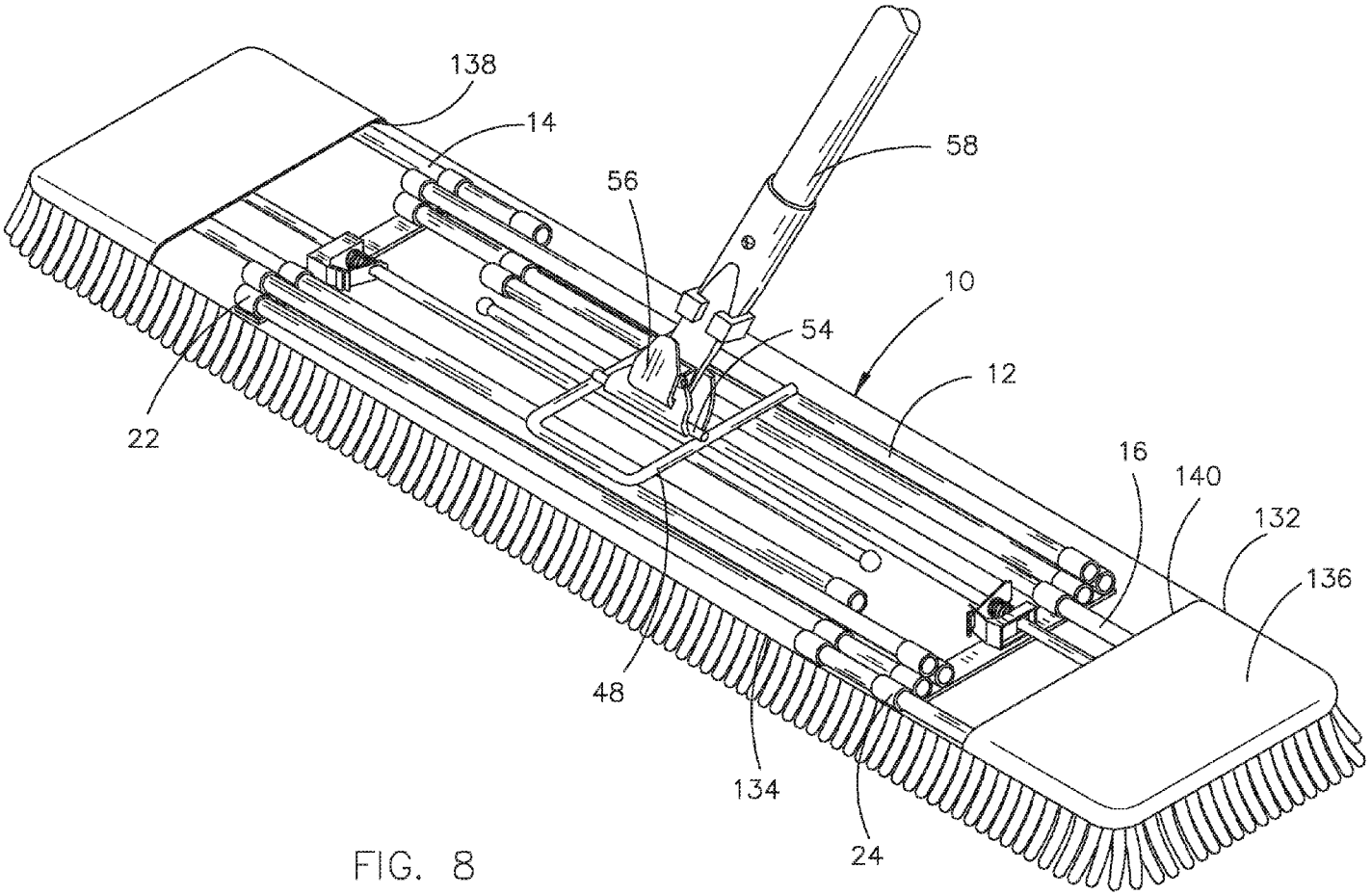
FIG. 8 is a perspective view of the mop frame of FIG. 1 showing a handle and dust mop head mounted to the mop frame.

Base 12 includes a handle mount 48, shown in FIG. 1, which is joined to the first side frame member 40 and to the second side frame member 42 at approximately the center of base 12 along its longitudinal axis 26. Handle mount 48 includes crossbars 50 and 52 that are each positioned perpendicular to and joined to first side frame member 40 and second side frame member 42. Handle mount 48 includes a mounting rail 54 that is positioned perpendicular to and is joined to crossbars 50 and 52. Mounting rail 54 is positioned approximately equidistant from first side frame member 40 and second side frame member 42. As shown in FIG. 8, mounting rail 54 is configured to be clamped by a handle clamp 56 joined to the end of a handle 58.

As described in more detail below and shown in FIGS. 6 and 7, first extension 14 and second extension 16 are slidably supported with respect to base with a first bushing 80 of first extension 14, a second bushing 98 of second extension 16, a third bushing 82 of first extension 14, a fourth bushing 100 of second extension 16, and a fifth bushing 60, a sixth bushing 62, a seventh bushing 64, and an eighth bushing 66 of base 12. First bushing 80 receives first rail 28, second bushing 98 receives second rail 30, third bushing 82 receives third rail 32, and fourth bushing 100 receives fourth rail 34. Fifth bushing 60 receives a first slide 72 of first extension 14, sixth bushing 62 receives a second slide 90 of second extension 16, seventh bushing 64 receives a third slide 74 of first extension 14, and eighth bushing 66 receives a fourth slide 92 of second extension 16.

The fifth bushing 60 and seventh bushing 64 (FIG. 6) are mounted to the first end frame member 36, and the sixth bushing 62 and eighth bushing 66 (FIG. 7) are mounted to the second end frame member 38. The fifth bushing 60, sixth bushing 62, seventh bushing 64, and eighth bushing 66 are preferably joined to first end frame member 36 or second end frame member 38 by welding; however, it is within the scope of the invention for the bushings to be mounted in any manner. Each of fifth bushing 60, sixth bushing 62, seventh bushing 64, and eighth bushing 66 is a cylindrical tube with an opening therethrough that is operable to receive and slidably support a portion of first extension 14 or second extension 16, as described below. Fifth bushing 60 is positioned between first rail 28 and first lock 18, sixth bushing 62 is positioned along an outer edge of base 12 adjacent second rail 30, seventh bushing 64 is positioned along an outer edge of base 12 adjacent third rail 32, and eighth bushing 66 is positioned between fourth rail 34 and second lock 20. Preferably, fifth bushing 60 and seventh bushing 64 are spaced apart approximately the same distance as the distance between sixth bushing 62 and eighth bushing 66.

Figure 3:
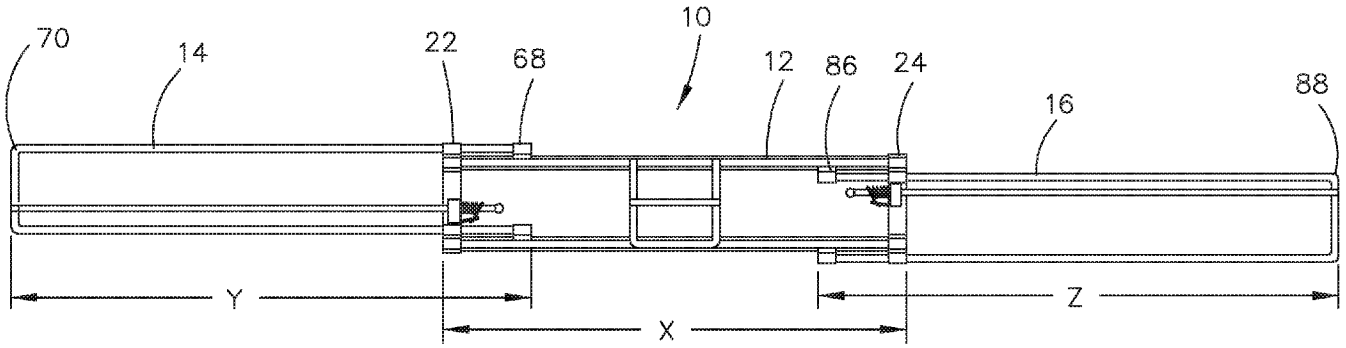
FIG. 3 is a top plan view of the mop frame of FIG. 1 showing extensions in extended positions.

As shown in FIG. 6, first extension 14 has a proximal end 68 and a distal end 70. First extension 14 has a generally U-shaped configuration with first slide 72 and third slide 74 being joined at the distal end 70 to an end frame member 76. A first locking pin 78 is joined to end frame member 76 between the first slide 72 and third slide 74. First slide 72, third slide 74, and first locking pin 78 are generally parallel to each other. End frame member 76 is generally perpendicular to first slide 72, third slide 74, and first locking pin 78. First slide 72, third slide 74, and first locking pin 78 may be joined to end frame member 76 in any manner, including by welding. Further, first slide 72, third slide 74, and/or first locking pin 78 may be formed integrally with end frame member 76 from the same material. Each of first slide 72, third slide 74, end frame member 76, and first locking pin 78 is configured as a cylindrical rod; however, it is within the scope of the invention for these components to have any shape, including a hollow tubular shape. As shown in FIG. 3, first extension 14 has a length Y extending along the longitudinal axis 26 from the proximal end 68 to the distal end 70. The length Y of first extension 14 is preferably approximately the same as the length X of base 12.

At the proximal end 68, as shown in FIG. 6, first bushing 80 of first extension 14 has an opening that slidably receives first rail 28 and third bushing 82 has an opening that slidably receives third rail 32. First bushing 80 is mounted to first slide 72 so that the opening through first bushing 80 is generally parallel to and offset from first slide 72. Third bushing 82 is mounted to third slide 74 so that the opening through third bushing 82 is generally parallel to and offset from third slide 74. First bushing 80 and third bushing 82 may be joined to first slide 72 and third slide 74, respectively, in any manner, including by welding. First bushing 80 and third bushing 82 may also be formed integrally from the same material with first slide 72 and third slide 74. First bushing 80 and third bushing 82 are spaced apart approximately the same distance as the distance between first rail 28 and third rail 32. First locking pin 78 includes a stopper 84 at proximal end 68, which prevents first locking pin 78 from being pulled through first lock 18, as described below.

First slide 72 is slidably received by the opening through fifth bushing 60 of base 12 and third slide 74 is slidably received by the opening through seventh bushing 64 of base 12. The slidable reception of first slide 72 by fifth bushing 60, of third slide 74 by seventh bushing 64, of first rail 28 by first bushing 80, and of third rail 32 by third bushing 82 provides four sliding contact points by which base 12 supports first extension 14 and allows first extension 14 to slide relative to base 12. First extension 14 is operable to slide with respect to base 12 in a direction aligned with longitudinal axis 26 between a retracted position shown in FIG. 4, in which the proximal end 68 of first extension 14 is adjacent the second end 24 of base 12 and the distal end 70 of first extension 14 is adjacent the first end 22 of base 12, and an extended position shown in FIG. 3, in which the proximal end 68 of first extension 14 is adjacent the first end 22 of base 12.

Figure 7:
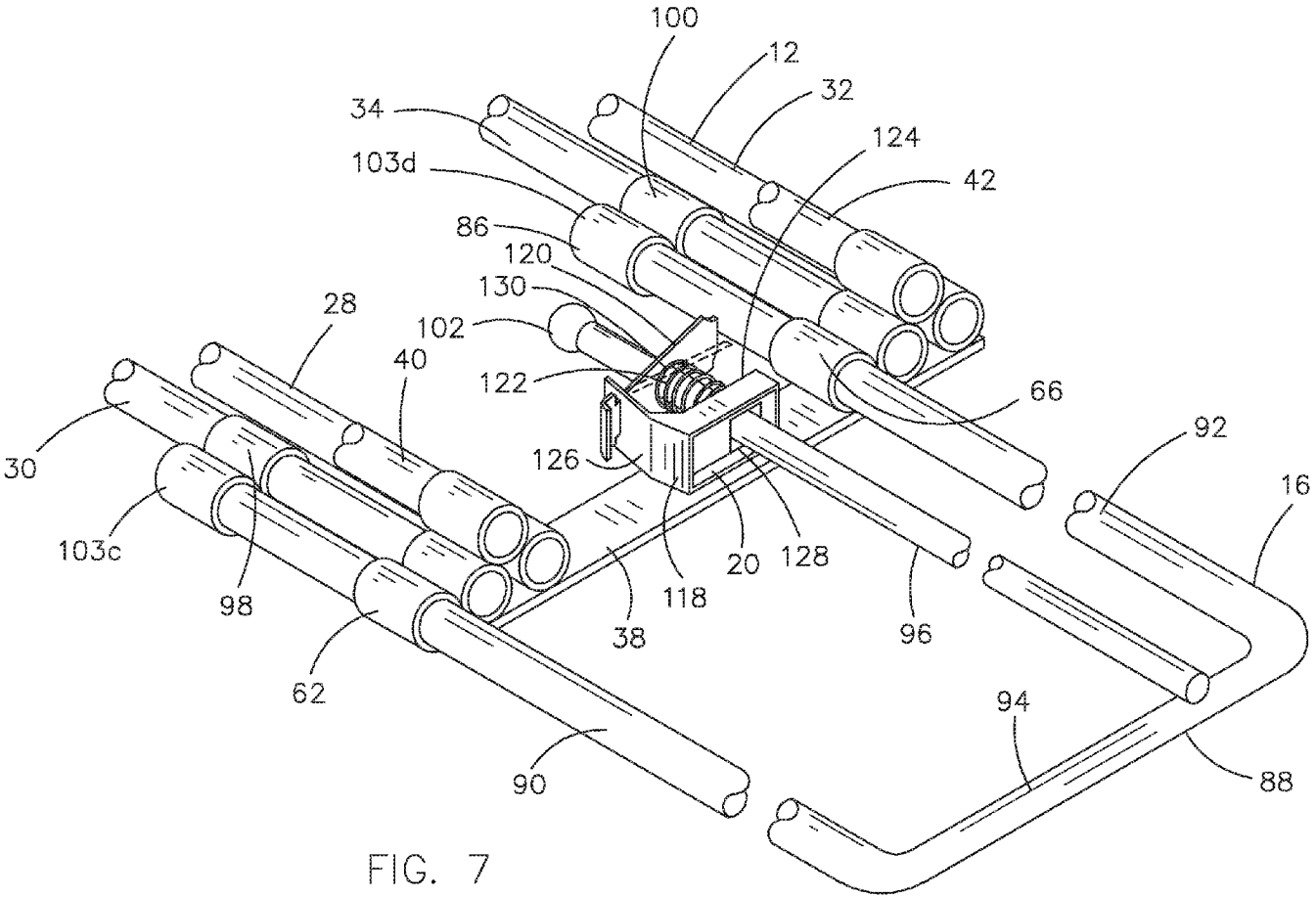
FIG. 7 is a perspective view showing a second end of the base of the mop frame of FIG. 1.

As shown in FIG. 7, second extension 16 has a proximal end 86 and a distal end 88. Second extension 16 has a generally U-shaped configuration with second slide 90 and fourth slide 92 being joined at the distal end 88 to an end frame member 94. A second locking pin 96 is joined to end frame member 94 between the second slide 90 and fourth slide 92. Second slide 90, fourth slide 92, and second locking pin 96 are generally parallel to each other. End frame member 94 is generally perpendicular to second slide 90, fourth slide 92, and second locking pin 96. Second slide 90, fourth slide 92, and second locking pin 96 may be joined to end frame member 94 in any manner, including by welding. Further, second slide 90, fourth slide 92, and/or second locking pin 96 may be formed integrally with end frame member 94 from the same material. Each of second slide 90, fourth slide 92, end frame member 94, and second locking pin 96 is configured as a cylindrical rod; however, it is within the scope of the invention for these components to have any shape, including a hollow tubular shape. As shown in FIG. 3, second extension 16 has a length Z extending along the longitudinal axis 26 from the proximal end 86 to the distal end 88. The length Z of second extension 16 is preferably approximately the same as the length X of base 12 and the length Y of first extension 14.

At the proximal end 86, as shown in FIG. 7, second bushing 98 of second extension 16 has an opening that slidably receives second rail 30 and fourth bushing 100 has an opening that slidably receives fourth rail 34. Second bushing 98 is mounted to second slide 90 so that the opening through second bushing 98 is generally parallel to and offset from second slide 90. Fourth bushing 100 is mounted to fourth slide 92 so that the opening through fourth bushing 100 is generally parallel to and offset from fourth slide 92. Second bushing 98 and fourth bushing 100 may be joined to second slide 90 and fourth slide 92, respectively, in any manner, including by welding. Second bushing 98 and fourth bushing 100 may also be formed integrally from the same material with second slide 90 and fourth slide 92. Second bushing 98 and fourth bushing 100 are spaced apart approximately the same distance as the distance between second rail 30 and fourth rail 34. Second locking pin 96 includes a stopper 102 at proximal end 86, which prevents second locking pin 96 from being pulled through second lock 20, as described below.

Second slide 90 is slidably received by the opening through sixth bushing 62 of base 12 and fourth slide 92 is slidably received by the opening through eighth bushing 66 of base 12. The slidable reception of second slide 90 by sixth bushing 62, of fourth slide 92 by eighth bushing 66, of second rail 30 by second bushing 98, and of fourth rail 34 by fourth bushing 100 provides four sliding contact points by which base 12 supports second extension 16 and allows second extension 16 to slide relative to base 12. Second extension 16 is operable to slide with respect to base 12 in a direction aligned with longitudinal axis 26 between a retracted position shown in FIG. 4, in which the proximal end 86 of second extension 16 is adjacent the first end 22 of base 12 and the distal end 88 of second extension 16 is adjacent the second end 24 of base 12, and an extended position shown in FIG. 3, in which the proximal end 86 of second extension 16 is adjacent the second end 24 of base 12.

First slide 72 includes a stopper 103*a*, shown in FIG. 6, at proximal end 68 that receives and is joined to, preferably by welding a longer rod 105. The first bushing 80 is mounted to stopper 103*a*. Alternatively, it is within the scope of the invention for first slide 72 to be constructed from one continuous piece, such as rod 105, which is directly mounted to first bushing 80. Second slide 90, third slide 74, and fourth slide 92 also have a similar construction as first slide 72 with stoppers 103*b-d* at proximal end 68 or proximal end 86 that are joined to a longer rod. It is also within the scope of the invention for second slide 90, third slide 74, and fourth slide 92 to be constructed from one continuous piece that is directly mounted to second bushing 98, third bushing 82, or fourth bushing 100 without the use of stoppers 103*b-d*. The stopper 103*a* of first slide 72 and the stoppers 103*b-d* of second slide 90, third slide 74, and fourth slide 92 can engage one of the fifth bushing 60, sixth bushing 62, seventh bushing 64, and eighth bushing 66 to prevent first and second extensions 14 and 16 from being disconnected from base 12 when in the extended positions.

Referring to FIG. 6, first lock 18 includes a support 104 mounted to the first end frame member 36, a tab 106 that is rotatably coupled to the support 104, and a spring 108 positioned between the tab 106 and a support surface 110 of support 104. First lock 18 is positioned between first rail 28 and third rail 32, and first lock 18 is positioned between second rail 30 and fourth rail 34.

Support 104 is configured as a box that is mounted to first end frame member 36. Support 104 is preferably mounted to first end frame member 36 by welding, but may be joined to first end frame member 36 in any suitable manner. Support 104 includes an extension 112 with an opening that receives a portion of tab 106 in a manner that allows tab 106 to rotate with respect to support 104. Support 104 includes an opening 114 that slidably receives first locking pin 78. Tab 106 has a first end that is received by extension 112 and a second end with an opening 116 that slidably receives first locking pin 78. First locking pin 78 passes through the center of spring 108.

Tab 106 is movable with respect to support surface 110 between an engaged position, shown in solid lines in FIG. 6, and a disengaged position, shown in broken lines in FIG. 6. In the engaged position, a portion of tab 106 surrounding opening 116 frictionally engages the first locking pin 78 to releasably lock the first extension 14 in a desired position with respect to base 12, which may be the retracted position shown in FIG. 4, the extended position shown in FIG. 3, and any position between the retracted position and the extended position. In the disengaged position, first extension 14 is operable to slide relative to the tab 106, first lock 18, and base 12 between the retracted and extended positions. Spring 108 biases the tab 106 to the engaged position so that first extension 14 is normally locked to base 12. A user must move tab 106 to the disengaged position by compressing spring 108 before first extension 14 can be moved relative to base 12. Stopper 84 has a diameter that is larger than the diameter of the opening 116 in tab 106 to prevent first locking pin 78 from being pulled through tab 106.

Referring to FIG. 7, second lock 20 includes a second support 118 mounted to the second end frame member 38, a second tab 120 that is rotatably coupled to the second support 118, and a second spring 122 positioned between the second tab 120 and a second support surface 124 of second support 118. Second lock 20 is positioned between first rail 28 and third rail 32, and second lock 20 is positioned between second rail 30 and fourth rail 34.

Second support 118 is configured as a box that is mounted to second end frame member 38. Second support 118 is preferably mounted to second end frame member 38 by welding, but may be joined to second end frame member 38 in any suitable manner. Second support 118 includes an extension 126 with an opening that receives a portion of second tab 120 in a manner that allows second tab 120 to rotate with respect to second support 118. Second support 118 includes an opening 128 that slidably receives second locking pin 96. Second tab 120 has a first end that is received by extension 126 and a second end with an opening 130 that slidably receives second locking pin 96. Second locking pin 96 passes through the center of second spring 122.

Second tab 120 is movable with respect to second support surface 124 between an engaged position, shown in solid lines in FIG. 7, and a disengaged position, shown in broken lines in FIG. 7. In the engaged position, a portion of second tab 120 surrounding opening 130 frictionally engages the second locking pin 96 to releasably lock the second extension 16 in a desired position with respect to base 12, which may be the retracted position shown in FIG. 4, the extended position shown in FIG. 3, and any position between the retracted position and the extended position. In the disengaged position, second extension 16 is operable to slide relative to the second tab 120, second lock 20, and base 12 between the retracted and extended positions. Second spring 122 biases the second tab 120 to the engaged position so that second extension 16 is normally locked to base 12. A user must move second tab 120 to the disengaged position by compressing second spring 122 before second extension 16 can be moved relative to base 12. Stopper 102 has a diameter that is larger than the diameter of the opening 130 in second tab 120 to prevent second locking pin 96 from being pulled through second tab 120.

Figure 4:
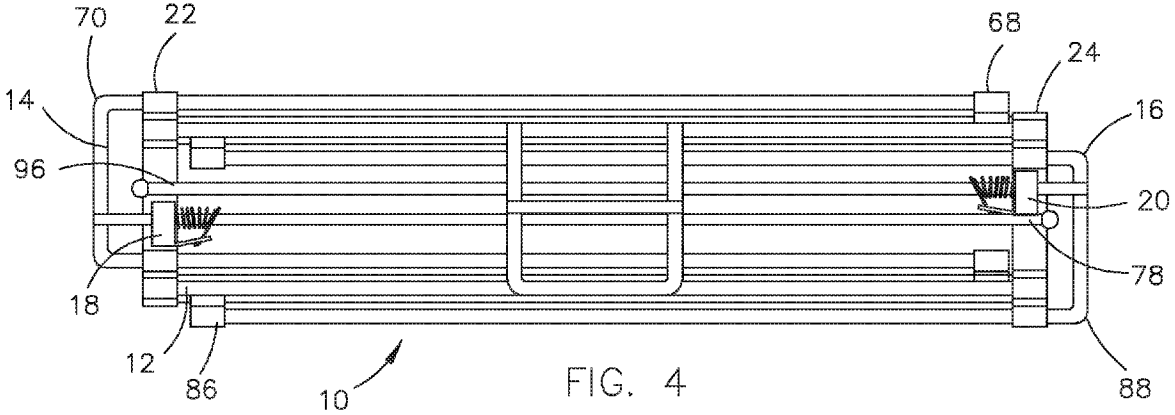
FIG. 4 is a top plan view of the mop frame of FIG. 1 showing the extensions in retracted positions.

As shown in FIG. 4, first lock 18 is positioned so that it does not interfere with the movement of second locking pin 96 when second extension 16 is in the retracted position, and second lock 20 is positioned so that it does not interfere with the movement of first locking pin 78 when first extension 14 is in the retracted position. In an alternative embodiment, first locking pin 78 and second locking pin 96 may be formed from a plurality of collapsible tubes, similar to a car radio antenna, that extend relative to each other as first extension 14 and second extension 16 are moved to their extended positions, and that collapse relative to each other as first extension 14 and second extension 16 are moved to their retracted positions. First lock 18 and second lock 20 may have a different configuration than the preferred one described herein.

The length X of base 12 is preferably between approximately 20 to 24 inches, and most preferably between approximately 20 to 21 inches. The length Y of first extension 14 is preferably between approximately 20 to 24 inches, and most preferably between approximately 20 to 21 inches. The length Z of second extension 16 is preferably between approximately 20 to 24 inches, and most preferably between approximately 20 to 21 inches. The overall length of the mop frame 10 along longitudinal axis 26 when first and second extensions 14 and 16 are in the retracted positions shown in FIG. 4 is preferably between approximately 20 to 24 inches, and more preferably between approximately 20 to 21 inches. The overall length of the mop frame 10 along longitudinal axis 26 when first and second extensions 14 and 16 are in the extended positions shown in FIG. 3 is preferably between approximately 60 to 72 inches, and more preferably between approximately 60 to 63 inches. In one embodiment, mop frame 10 has an overall length when first and second extensions 14 and 16 are in the retracted positions of approximately 21 inches and an overall length when first and second extensions 14 and 16 are in the extended positions of approximately 63 inches, which allows mop frame to be used with a mop head having a relatively short length of 21 inches, a relatively long length of 63 inches and any length therebetween. In another embodiment, mop frame 10 has an overall length when first and second extensions 14 and 16 are in the retracted positions of approximately 24 inches and an overall length when first and second extensions 14 and 16 are in the extended positions of approximately 72 inches, which allows mop frame to be used with a mop head having a relatively short length of 24 inches, a relatively long length of 72 inches and any length therebetween. The components of mop frame 10 are preferably constructed from a durable metal such as steel; however, it is within the scope of the invention for mop frame 10 to be constructed from any suitable material, including a polymeric material.

Figure 5:
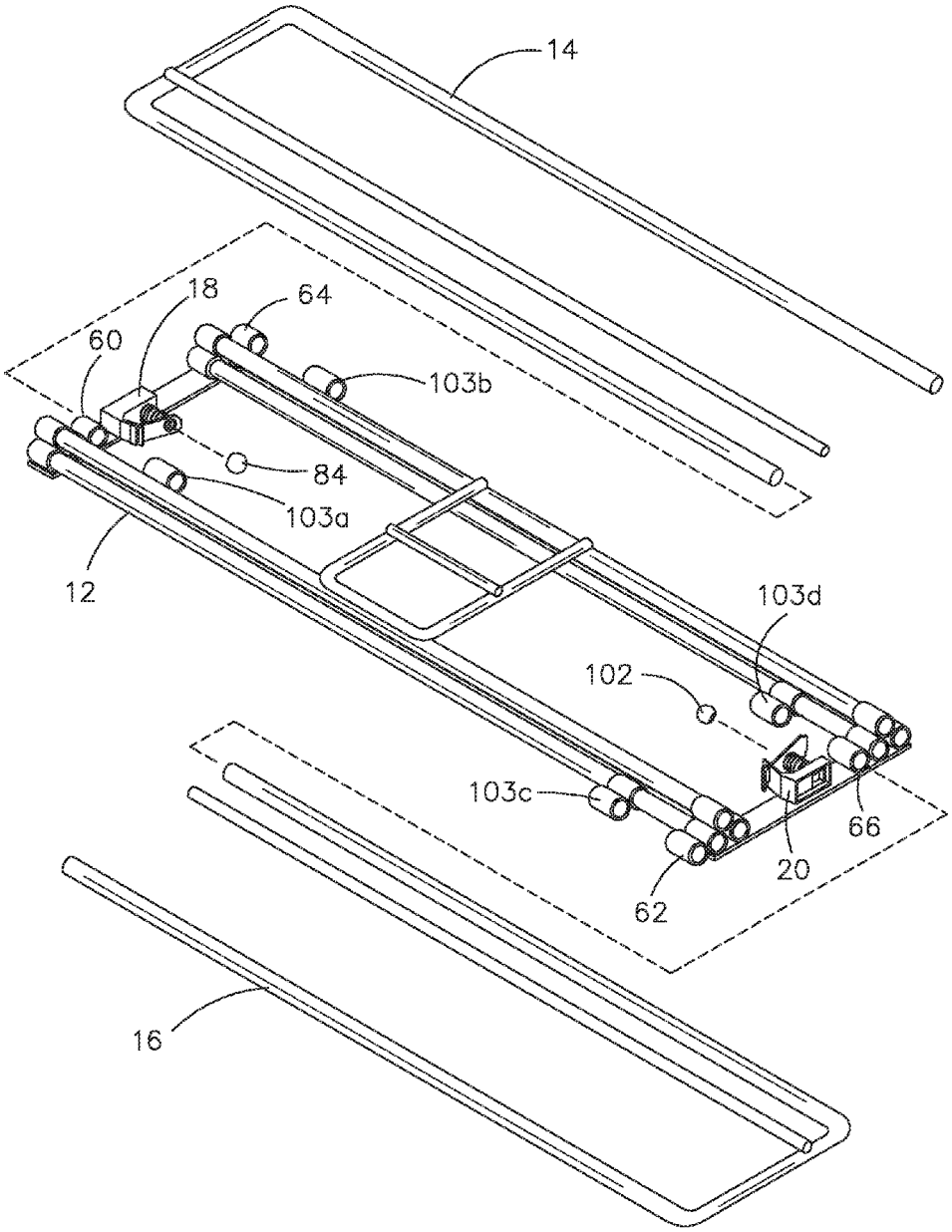
FIG. 5 is a perspective, partially exploded view of the mop frame of FIG. 1.

FIG. 5 is illustrative of one method for assembling first extension 14 and second extension 16 with base 12. Base 12 may be assembled with stoppers 103*a-d* and their associated first, second, third, and fourth bushings 80, 98, 82, and 100 slidably received by first, second, third, and fourth rails 28, 30, 32, and 34. First extension 14 may be assembled without these stoppers 103*a-b* and without stopper 84. The components of first extension 14 then slide through fifth bushing 60, first lock 18, and seventh bushing 64. Stoppers 103*a-b* and stopper 84 are then joined to the components of first extension 14 as described above. Likewise, second extension 16 may be assembled without stoppers 103*c-d* and without stopper 102. The components of second extension 16 then slide through sixth bushing 62, second lock 20, and eighth bushing 66. Stoppers 103*c-d* and stopper 102 are then joined to the components of second extension 16 as described above.

FIG. 8 shows mop frame 10 as it is used with a handle 58 joined to handle mount 48 and a mop head 132 mounted to mop frame 10. Mop head 132 has a lower surface 134 that engages a floor surface to be cleaned and an upper surface 136. Upper surface 136 includes pockets 138 and 140 formed at each end of mop head 132. Each of pockets 138 and 140 is configured for receiving one of the ends of mop frame 10 to mount mop head 132 to mop frame 10 in a manner so that the lower surface 134 is substantially planar and horizontal. The pockets 138 and 140 receive the distal ends 70 and 88 of first and second extensions 14 and 16, respectively, and may receive a portion of the first and second ends 22 and 24 of base 12 when the first and second extensions 14 and 16 are in the retracted positions. Mop frame 10 may be configured for use with mop heads of any length, including 22", 24", 30", 36", 42", 48", 54", 60", 66", and 72". Mop frame 10 and mop head 132 are preferably used for dust control.

Figure 9:
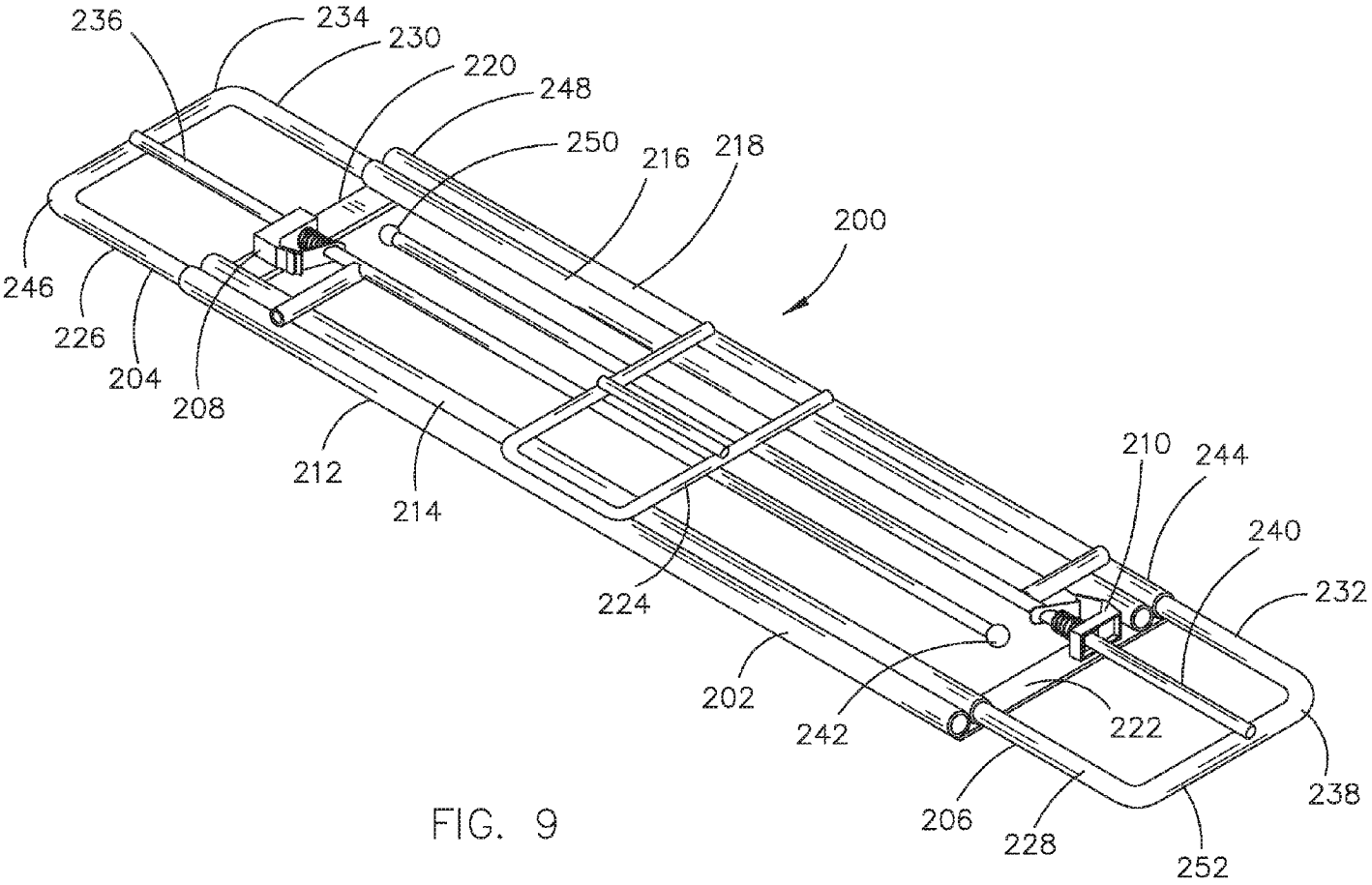
FIG. 9 is a perspective view of an alternative embodiment of mop frame in accordance with the invention described herein showing extensions in retracted positions.
Figure 10:
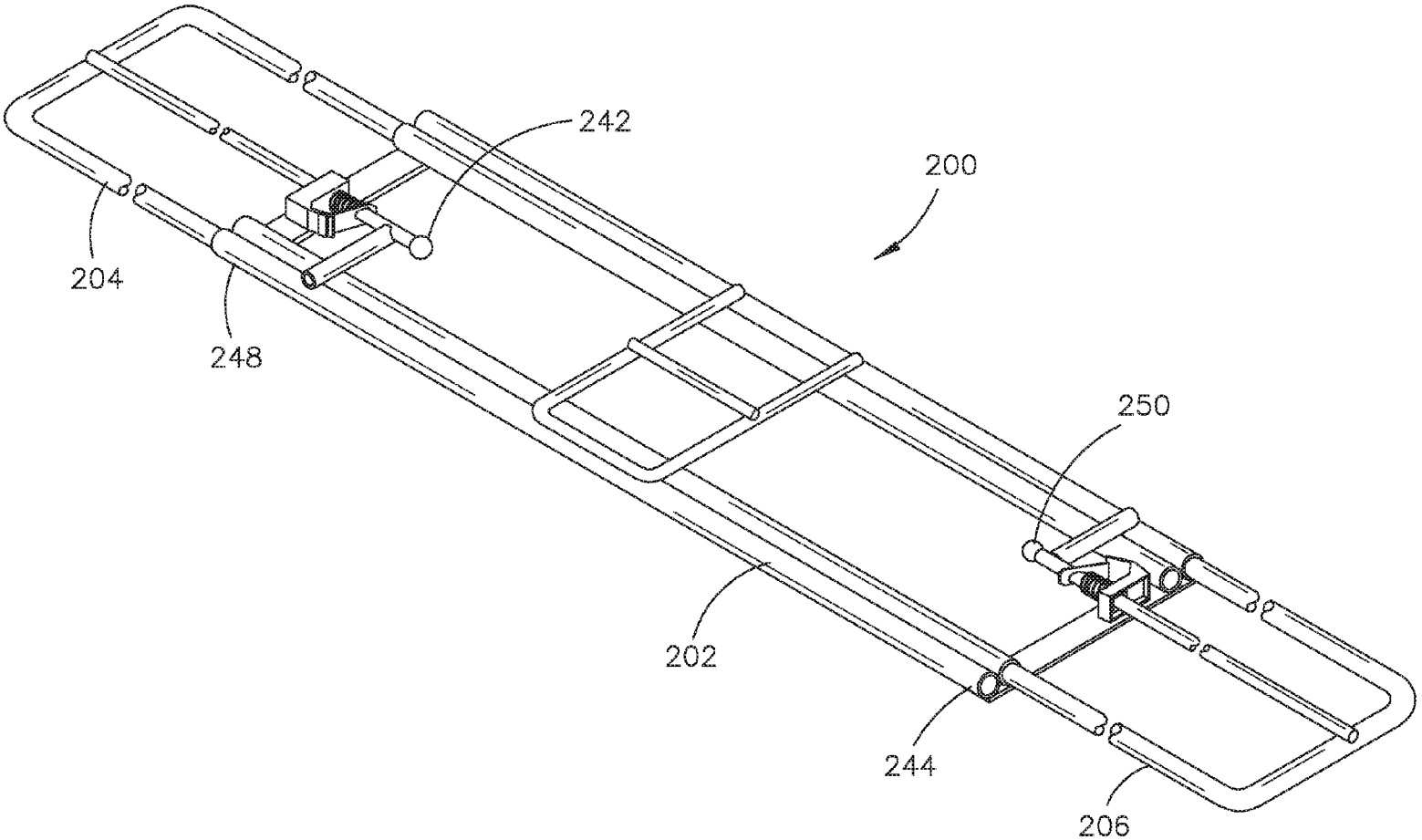
FIG. 10 is a perspective view of the mop frame of FIG. 10 showing the extensions in extended positions.

FIGS. 9 and 10 show an alternative embodiment of mop frame 200 in accordance with the invention described herein. Mop frame 200 includes a base 202, a first extension 204, a second extension 206, a first lock 208, and a second lock 210. Base 202 includes a first tube 212, a second tube 214, a third tube 216, and a fourth tube 218 each of which is mounted on one end to a first end frame member 220 and at the opposite end to a second end frame member 222. A handle mount 224 is mounted to first tube 212 and fourth tube 218 and has a similar configuration as the handle mount of mop frame 10 described above.

First extension 204 includes a first slide 226 that is slidably received within first tube 212, second extension 206 includes a second slide 228 that is slidably received within second tube 214, first extension 204 includes a third slide 230 that is slidably received within third tube 216, and second extension 206 includes a fourth slide 232 that is slidably received within fourth tube 218. First extension 204 includes an end frame member 234 that is joined to an end of each of first slide 226 and third slide 230. First extension 204 includes a first locking pin 236 that is received and engageable by first lock 208. Second extension 206 includes an end frame member 238 that is joined to an end of each of second slide 228 and fourth slide 232. Second extension 206 includes a second locking pin 240 that is received and engageable by second lock 210.

First lock 208 is mounted to the first end frame member 220, and second lock 210 is mounted to the second end frame member 222. First lock 208 and second lock 210 have a similar configuration as described above with respect to the locks of mop frame 10 and thus are not described in detail herein.

First extension 204 and second extension 206 are slidable with respect to base 202 between retracted positions shown in FIG. 9 and extended positions shown in FIG. 10. First lock 208 may releasably lock first extension 204 in the retracted position, the extended position, and any position therebetween. Second lock 210 may releasably lock second extension 206 in the retracted position, the extended position, and any position therebetween. In the retracted position shown in FIG. 9, a proximal end 242 of first extension 204 is positioned adjacent a second end 244 of base 12, and a distal end 246 of first extension 204 is positioned adjacent a first end 248 of base 12. In the extended position shown in FIG. 10, proximal end 242 of first extension 204 is positioned adjacent the first end 248 of base 12. In the retracted position shown in FIG. 9, a proximal end 250 of second extension 206 is positioned adjacent the first end 248 of base 12, and a distal end 252 of second extension 206 is positioned adjacent the second end 244 of base 12. In the extended position shown in FIG. 10, proximal end 250 of second extension 206 is positioned adjacent the second end 244 of base 12. Mop frame 200 may have dimensions consistent with those described above for mop frame 10.

Figure 11:
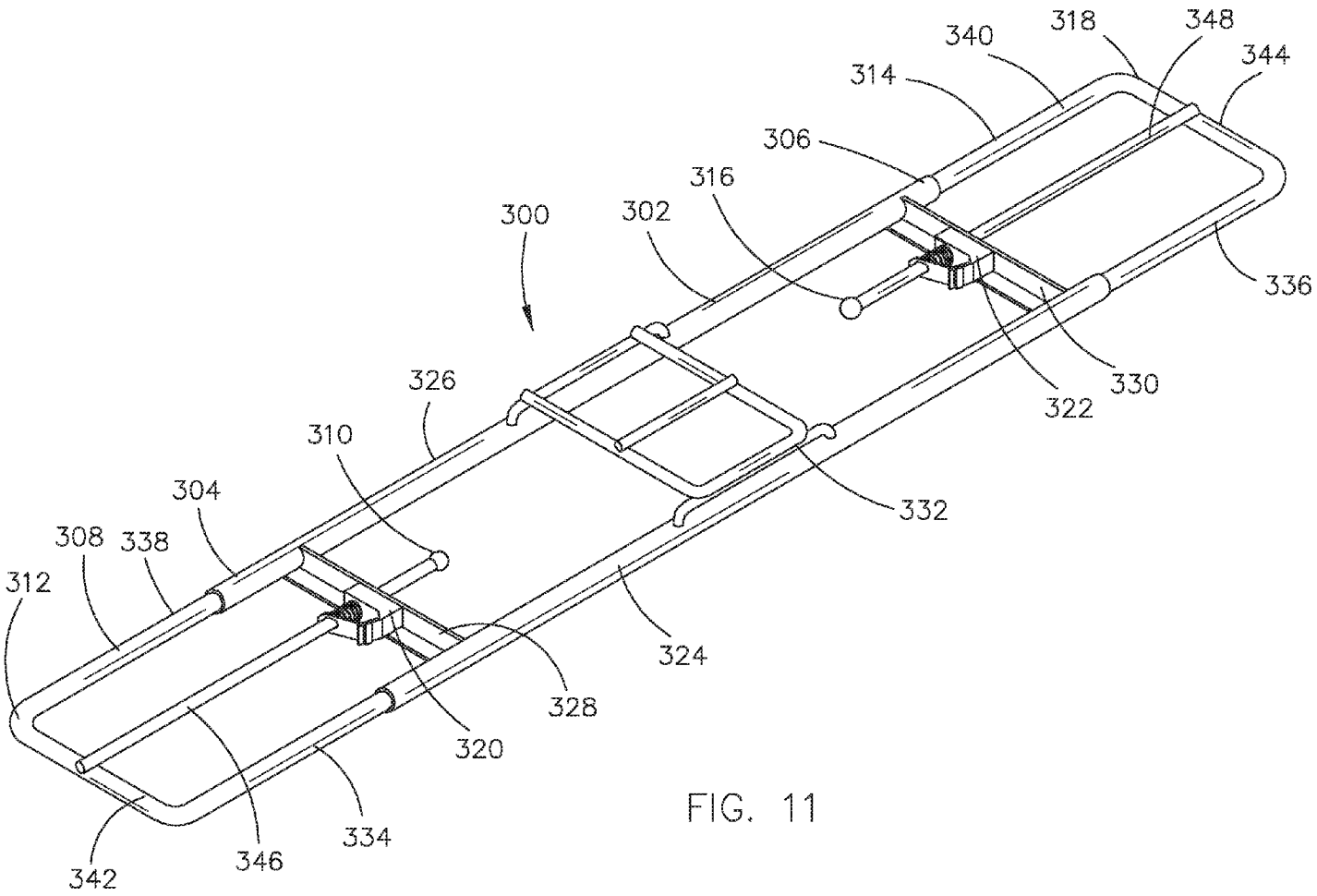
FIG. 11 is a perspective view of another alternative embodiment of mop frame in accordance with the invention described herein.

FIG. 11 shows an alternative embodiment of mop frame 300 in accordance with the invention described herein. Mop frame 300 includes a base 302 with a first end 304 and a second end 306, a first extension 308 with a proximal end 310 and a distal end 312, a second extension 314 with a proximal end 316 and a distal end 318, a first lock 320 mounted to base 302, and a second lock 322 mounted to base 302. Base 302 includes a first tube 324 and a second tube 326 each of which is mounted adjacent one end to a first end frame member 328 and adjacent the opposite end to a second end frame member 330. Base 302 includes a handle mount 332 that is mounted to first tube 324 and second tube 326 and that has a similar configuration as the handle mount of mop frame 10 described above.

First extension 308 includes a first slide 334 that is slidably received within first tube 324, second extension 314 includes a second slide 336 that is slidably received within first tube 324, first extension 308 includes a third slide 338 that is slidably received within second tube 326, and second extension 314 includes a fourth slide 340 that is slidably received within second tube 326. First extension 308 includes a first end frame member 342 that is joined to an end of each of first slide 334 and third slide 338 at the distal end 312. Second extension 314 includes a second end frame member 344 that is joined to an end of each of second slide 336 and fourth slide 340 at the distal end 318. First extension 308 includes a first locking pin 346 that is received and engageable by first lock 320. Second extension 314 includes a second locking pin 348 that is received and engageable by second lock 322.

First lock 320 is mounted to the first end frame member 328, and second lock 322 is mounted to the second end frame member 330. First lock 320 and second lock 322 have a similar configuration as described above with respect to the locks of mop frame 10 and thus are not described in detail herein.

First extension 308 and second extension 314 are slidable with respect to base 302 between retracted positions and extended positions in a similar manner as described above with respect to mop frames 10 and 200. In the retracted positions, the distal ends 312 and 318 of first and second extensions 308 and 314 are adjacent the first end 304 and second end 306 of base 302, respectively. In the extended positions, the proximal ends 310 and 316 of first and second extensions 308 and 314 are adjacent the first end 304 and second end 306 of base 302, respectively.

Figure 12:
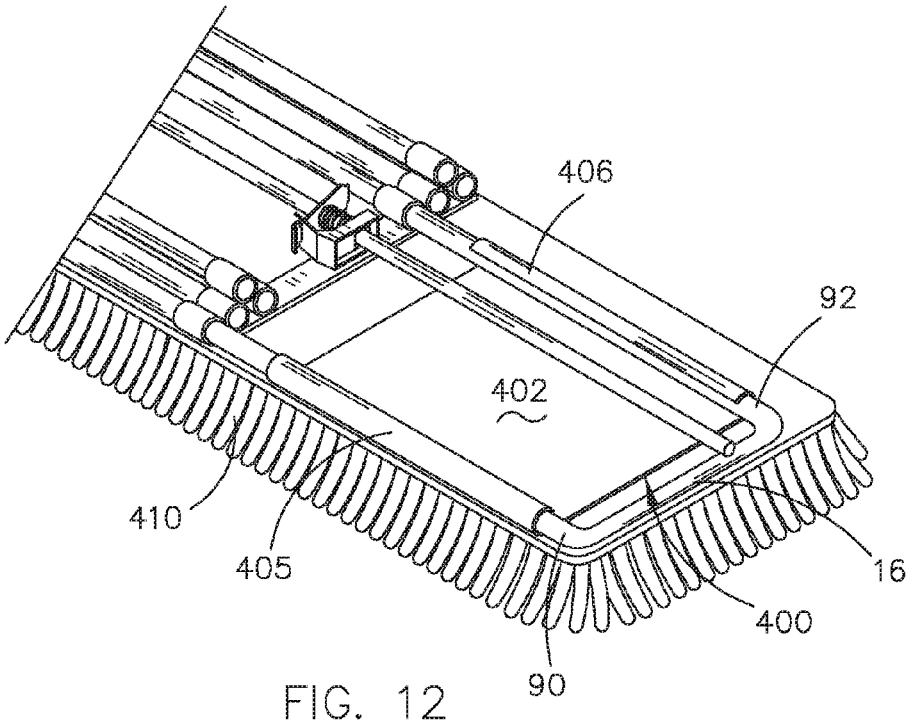
FIG. 12 is a perspective view of a portion of the mop frame of FIG. 1 showing a clip assembly mounted to one of the extensions.
Figure 13:
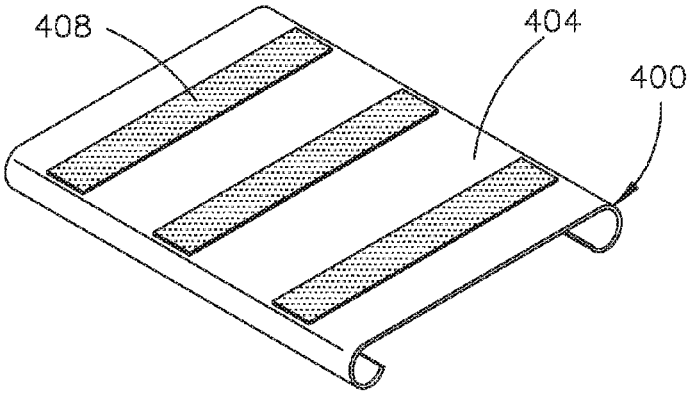
FIG. 13 is a perspective view of a bottom of the clip assembly shown in FIG. 12.

FIGS. 12 and 13 show a clip assembly 400 for use with any of the mop frames 10, 200, and 300. FIG. 12 shows clip assembly 400 mounted to second extension 16 of mop frame 10. Clip assembly 400 includes an upper surface 402 and a lower surface 404. Clip assembly 400 has rounded side edges 405 and 406 that form channels between the rounded side edges 405 and 406 and upper surface 402 which are configured for tightly receiving second slide 90 and fourth slide 92 of second extension 16 to mount clip assembly 400 to second extension 16. Strips of hook material (one of which is shown as 408 in FIG. 13) are joined to the lower surface 404 of clip assembly 400. A mop head 410 has loop material (not shown) on its upper surface that engages the strips of hook material 408 to releasably mount mop head 410 to clip assembly 400 and mop frame 10, as shown in FIG. 12. It is also within the scope of the invention for the mop head 410 to have hook material that engages loop material on the clip assembly 400. Another clip assembly 400 is joined to first extension 14 in a similar manner to releasably engage the opposite end of mop head 410 such that mop head 410 extends the entire length of mop frame 10. The rounded side edges 405 and 406 of clip assembly 400 may also mount to the first rail 28 and third rail 32 of base 12 (FIG. 6), or to the second rail 30 and the fourth rail 34 of base 12. More than two clip assemblies 400 may be mounted to mop frame 10 to releasably mount mop head 410 to mop frame 10. For example, one or more clip assemblies 400 may mount to first extension 14, one or more clip assemblies 400 may mount to second extension 16, one or more clip assemblies 400 may mount to first rail 28 and third rail 32, and/or one or more clip assemblies 400 may mount to second rail 30 and fourth rail 34. Clip assemblies 400 may also mount to first extension 204 and second extension 206 of mop frame 200 (FIG. 10) to releasably mount mop head 410 to mop frame 200. Further, clip assemblies 400 may also mount to first extension 308 and second extension 314 of mop frame 300 (FIG. 11) to releasably mount mop head 410 to mop frame 300.

In use, mop frame 10 is first adjusted to a desired length that matches the length of a mop head, such as mop head 132 shown in FIG. 8, desired for mounting on mop frame 10. Mop frame 10 is adjusted by extending or retracting first and second extensions 14 and 16. First extension 14 is extended or retracted by pressing on the tab 106 (FIG. 6) of first lock 18 and compressing spring 108 until tab 106 no longer frictionally engages first locking pin 78. First extension 14 may then be extended or retracted to a desired position. Pressure on tab 106 is then released so that spring 108 biases tab 106 to the engaged position, in which it frictionally engages first locking pin 78 to prevent movement of first extension 14 relative to base 12. In similar fashion, second extension 16 is extended or retracted by pressing on the second tab 120 (FIG. 7) of second lock 20 and compressing second spring 122 until second tab 120 no longer frictionally engages second locking pin 96. Second extension 16 may then be extended or retracted to a desired position. Pressure on second tab 120 is then released so that second spring 122 biases second tab 120 to the engaged position, in which it frictionally engages second locking pin 96 to prevent movement of second extension 16 relative to base 12.

When first and second extensions 14 and 16 are in the desired position, the pockets 138 and 140 (FIG. 8) on mop head 132 are positioned to receive the ends of mop frame 10 to mount the mop head 132 to mop frame 10. If the length of mop head 132 shrinks due to laundering after extended use, the user can simply retract first and second extensions 14 and 16 until the length of mop frame 10 matches the shortened overall length of mop head 132. Further, if the user desires to use a different mop head with mop frame 10 having a different length than mop head 132, the user may simply extend or retract first and second extensions 14 and 16 until the length of mop frame 10 matches the length of the desired mop head.

Mop frames 200 and 300 are used in a similar manner as described above with respect to mop frame 10. One or more clip assemblies 400 may be mounted to any of mop frames 10, 200, and 300 as described above so that a mop head 410 having hook or loop material may be releasably mounted to mop frames 10, 200, and 300.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A mop frame comprising:

a base comprising a first end and a second end, wherein a longitudinal axis of the base extends from the first end to the second end;

a first extension that is slidably coupled to the base, wherein the first extension comprises a proximal end and a distal end, and wherein the first extension is operable to slide with respect to the base in a direction aligned with the longitudinal axis between a retracted position, in which the proximal end of the first extension is adjacent the second end of the base, and an extended position, in which the proximal end of the first extension is adjacent the first end of the base;

a second extension that is slidably coupled to the base, wherein the second extension comprises a proximal end and a distal end, and wherein the second extension is operable to slide with respect to the base in a direction aligned with the longitudinal axis between a retracted position, in which the proximal end of the second extension is adjacent the first end of the base, and an extended position, in which the proximal end of the second extension is adjacent the second end of the base;

a first lock that is mounted to the base, wherein the first lock is operable to releasably lock the first extension to the base in any position between the retracted position and the extended position; and a second lock that is mounted to the base, wherein the second lock is operable to releasably lock the second extension to the base in any position between the retracted position and the extended position.

2. The mop frame of claim 1, wherein the distal end of the first extension is adjacent the first end of the base when the first extension is in the retracted position, and wherein the distal end of the second extension is adjacent the second end of the base when the second extension is in the retracted position.

3. The mop frame of claim 1, wherein the base comprises a length X extending along the longitudinal axis from the first end to the second end, wherein the first extension comprises a length Y extending along the longitudinal axis from the proximal end of the first extension to the distal end of the first extension, and wherein the length X is approximately the same as the length Y.

4. The mop frame of claim 3, wherein the second extension comprises a length Z extending along the longitudinal axis from the proximal end of the second extension to the distal end of the second extension, and wherein the length X is approximately the same as the length Z.

5. The mop frame of claim 1, wherein the base comprises a first rail that extends from the first end to the second end, wherein the base comprises a second rail that is coupled to the first rail and that extends from the first end to the second end, wherein the first extension comprises a first bushing with an opening that receives the first rail, and wherein the second extension comprises a second bushing with an opening that receives the second rail.

6. The mop frame of claim 5, wherein the base comprises a third rail that is coupled to the first rail and that extends from the first end to the second end, wherein the base comprises a fourth rail that is coupled to the first rail and that extends from the first end to the second end, wherein the first extension comprises a third bushing with an opening that receives the third rail, and wherein the second extension comprises a fourth bushing with an opening that receives the fourth rail.

7. The mop frame of claim 6, wherein the base comprises a first end frame member that is positioned at the first end and that is coupled to the first rail, the second rail, the third rail, and the fourth rail, and wherein the base comprises a second end frame member that is positioned at the second end and that is coupled to the first rail, the second rail, the third rail, and the fourth rail.

8. The mop frame of claim 7, wherein the base comprises a first side frame member that is coupled to the first end frame member and the second end frame member, wherein the first side frame member is positioned above the first rail and the second rail, wherein the base comprises a second side frame member that is coupled to the first end frame member and the second end frame member, and wherein the second side frame member is positioned above the third rail and the fourth rail.

9. The mop frame of claim 8, wherein a handle mount is coupled to the first side frame member and the second side frame member.

10. The mop frame of claim 7, wherein the base comprises a fifth bushing that is coupled to the first end frame member, wherein the first extension comprises a first slide that is received by an opening in the fifth bushing, wherein the base comprises a sixth bushing that is coupled to the second end frame member, and wherein the second extension comprises a second slide that is received by an opening in the sixth bushing.

11. The mop frame of claim 10, wherein the base comprises a seventh bushing that is coupled to the first end frame member, wherein the first extension comprises a third slide that is received by an opening in the seventh bushing, wherein the base comprises an eighth bushing that is coupled to the second end frame member, and wherein the second extension comprises a fourth slide that is received by an opening in the eighth bushing.

12. The mop frame of claim 11, wherein the first extension comprises an end frame member that is coupled to the first slide and the third slide at the distal end of the first extension, and wherein the second extension comprises an end frame member that is coupled to the second slide and the fourth slide at the distal end of the second extension.

13. The mop frame of claim 12, wherein the first lock is mounted to the first end frame member, wherein the first lock is positioned between the first rail and the third rail, wherein the first lock is positioned between the second rail and the fourth rail, wherein the second lock is mounted to the second end frame member, wherein the second lock is positioned between the first rail and the third rail, and wherein the second lock is positioned between the second rail and the fourth rail.

14. The mop frame of claim 13, wherein the first extension comprises a first locking pin that is coupled to the end frame member of the first extension, and wherein the first lock comprises:

a support surface mounted to the first end frame member;

a tab that is coupled to the support surface, wherein the tab has an opening that receives the first locking pin, and wherein the tab is movable with respect to the support surface between an engaged position, in which a portion of the tab surrounding the opening in the tab engages the first locking pin to releasably lock the first extension in a desired position, and a disengaged position, in which the first extension is operable to slide relative to the tab; and a spring that is positioned between the tab and the support surface and that biases the tab to the engaged position.

15. The mop frame of claim 1, wherein the base comprises a first tube with an opening that receives a portion of the first extension, and wherein the base comprises a second tube with an opening that receives a portion of the second extension.

16. The mop frame of claim 1, further comprising a clip assembly that releasably mounts to the first extension, wherein the clip assembly comprises hook or loop material that is adapted to releasably engage hook or loop material of a mop head.

17. A mop frame comprising:

a base comprising a first end and a second end, wherein a longitudinal axis of the base extends from the first end to the second end;

a first extension that is slidably coupled to the base, wherein the first extension is operable to slide with respect to the base in a direction aligned with the longitudinal axis between a retracted position and an extended position;

a second extension that is slidably coupled to the base, wherein the second extension is operable to slide with respect to the base in a direction aligned with the longitudinal axis between a retracted position and an extended position; and a lock comprising:

a support surface mounted to the base;

a tab that is coupled to the support surface, wherein the tab has an opening that receives a portion of the first extension, and wherein the tab is movable with respect to the support surface between an engaged position, in which a portion of the tab surrounding the opening in the tab engages the first extension to releasably lock the first extension to the base in any position between the retracted position and the extended position, and a disengaged position, in which the first extension is operable to slide relative to the tab; and a spring that is positioned between the tab and the support surface and that biases the tab to the engaged position.

18. The mop frame of claim 17, further comprising a second lock comprising:

a second support surface mounted to the base;

a second tab that is coupled to the second support surface, wherein the second tab has an opening that receives a portion of the second extension, and wherein the second tab is movable with respect to the second support surface between an engaged position, in which a portion of the second tab surrounding the opening in the second tab engages the second extension to releasably lock the second extension to the base in any position between the retracted position and the extended position, and a disengaged position, in which the second extension is operable to slide relative to the second tab; and a second spring that is positioned between the second tab and the second support surface and that biases the second tab to the engaged position.

19. The mop frame of claim 17, wherein the first extension comprises a first slide that is received by an opening in the base, and wherein the first extension comprises a first locking pin that is coupled to the first slide and is received by the opening in the tab.

20. The mop frame of claim 19, wherein the first extension comprises a second slide that is received by a second opening in the base, and wherein the first extension comprises an end frame member that is coupled to the first slide, the first locking pin, and the second slide.

21. The mop frame of claim 17, wherein the first extension comprises a proximal end and a distal end, wherein the proximal end of the first extension is adjacent the second end of the base when the first extension is in the retracted position, wherein the proximal end of the first extension is adjacent the first end of the base when the first extension is in the extended position, wherein the second extension comprises a proximal end and a distal end, wherein the proximal end of the second extension is adjacent the first end of the base when the second extension is in the retracted position, and wherein the proximal end of the second extension is adjacent the second end of the base when the second extension is in the extended position.

22. The mop frame of claim 17, further comprising a clip assembly that releasably mounts to the first extension, wherein the clip assembly comprises hook or loop material that is adapted to releasably engage hook or loop material of a mop head.

* * * * *